US006178573B1

(12) United States Patent
Wagner et al.

(10) Patent No.: US 6,178,573 B1
(45) Date of Patent: Jan. 30, 2001

(54) VENTILATION UPGRADE KIT FOR A CRIB BUMPER AND METHOD OF USING IT

(76) Inventors: Allen S. Wagner; Gina Rae Wagner, both of 2736 Bliss Ct., Antioch, CA (US) 94509

( * ) Notice: Under 35 U.S.C. 154(b), the term of this patent shall be extended for 0 days.

(21) Appl. No.: 09/332,935

(22) Filed: Jun. 14, 1999

Related U.S. Application Data

(60) Provisional application No. 60/093,075, filed on Jul. 16, 1998.

(51) Int. Cl.[7] ..... A47D 15/00; A47D 21/08

(52) U.S. Cl. ..... 5/424; 5/946

(58) Field of Search ..... 5/424, 946, 93.1, 5/655, 425, 658

(56) References Cited

U.S. PATENT DOCUMENTS

| | | | | |
|---|---|---|---|---|
| 5,410,765 | | 5/1995 | Dicken | 5/93.1 |
| 5,706,534 | | 1/1998 | Sherman | 5/424 |
| 5,933,885 | * | 8/1999 | Glassford | 5/424 |
| 6,052,853 | * | 4/2000 | Schmid | 5/93.1 |
| 6,055,690 | * | 5/2000 | Koenig | 5/424 |

* cited by examiner

*Primary Examiner*—Alexander Grosz
(74) *Attorney, Agent, or Firm*—Townsend and Townsend and Crew LLP

(57) ABSTRACT

A ventilated crib bumper is provided for forming a safer protective barrier around the interior boundary of a crib. The crib typically has side supports defining an interior boundary extending around the periphery of a mattress disposed in the crib. The periphery of the mattress is spaced from the interior boundary by a spacing. The ventilated bumper is supported in the spacing. The ventilated bumper includes an upper bumper section disposed above the upper surface of the mattress and a lower bumper section disposed at least partly in the spacing between the interior boundary of the crib and the periphery of the mattress. The upper bumper section has at least one padded portion which includes flexible padding and at least one ventilated portion which includes a plurality of openings for ventilating between the interior of the crib and the exterior of the crib. In a specific embodiment, the ventilated portion includes a continuous strip of mesh extending substantially around the periphery of the mattress and disposed between the lower bumper section and the padded portion of the upper bumper section. A ventilation upgrade kit can be used to convert a non-ventilated bumper pad into a ventilated crib bumper easily and economically.

6 Claims, 6 Drawing Sheets

VENTILATION UPGRADE KIT FOR A CRIB BUMPER AND METHOD OF USING IT

CROSS-REFERENCES TO RELATED APPLICATIONS

This application is based on and claims priority of provisional application, Ser. No. 60/093,075, filed on Jul. 16, 1998.

BACKGROUND OF THE INVENTION

This invention relates generally to baby crib bumpers and, more particularly, to protecting an infant or a child from bodily impact against the sides of the crib while ventilating dangerous gases such as carbon dioxide out of the crib.

Crib bumper pads are widely used in baby cribs for protecting a child from injury caused by bodily impact against the sides of the crib that form the interior boundary of the crib. The accumulation of carbon dioxide or other dangerous gases inside the crib is a possible cause of Sudden Infant Death Syndrome (SIDS). Existing crib bumper pads, however, tend to trap these dangerous gases inside the crib. Those bumper pads may pose a serious threat to the health and well-being of children.

SUMMARY OF THE INVENTION

The present invention overcomes the difficulties and disadvantages of the prior art by providing a simple and effective way of ventilating the crib to minimize trapping of dangerous gases and ensure a supply of fresh air inside the crib. The invention provides a padded crib bumper having one or more ventilation portions with small openings that permit gas flow therethrough, particularly in the lower region of the crib. The ventilated crib bumper substantially eliminates trapping of dangerous gases, thereby lowering the risk of SIDS. At the same time, there is sufficient padding in the crib bumper to reduce bodily injury to the child caused by impact against the sides of the crib. The crib bumper can be used easily and conveniently to form a safer protective barrier around the interior boundary of the crib. The ventilated crib bumper can be inexpensively produced and does not require specialized manufacturing equipment.

In accordance with an embodiment of the present invention, a ventilated bumper pad is provided in a crib having spaced side supports defining an interior boundary extending around the periphery of a mattress disposed in the crib and being spaced from the periphery of the mattress by a spacing. The ventilated bumper pad is configured to be supported in the spacing between the interior boundary of the crib and the periphery of the mattress. The ventilated bumper pad comprises an upper bumper section disposed above the upper surface of the mattress. The upper bumper section has at least one padded portion which includes padding and at least one ventilated portion which includes a plurality of openings for ventilating between the interior of the crib and the exterior of the crib through the spaced side supports.

In a specific embodiment, the at least one ventilated portion comprises a mesh fine enough so that the child's fingers do not get caught in the mesh and the child's limbs will stay confined inside the interior boundary of the crib. The ventilated bumper pad includes a lower bumper section coupled with the upper bumper section and disposed at least partly in the spacing between the interior boundary of the crib and the periphery of the mattress. The lower bumper section serves to hold the mattress covering in place when tucked firmly in the spacing, thereby preventing the mattress covering from coming loose and bunching to create pockets that trap dangerous gases. The upper bumper section includes a ventilated portion which extends at least substantially around the periphery of the mattress. The ventilated portion has a lower boundary which is generally aligned with the upper surface of the mattress. The upper bumper section includes a padded section which is disposed above and coupled with the ventilated portion and which extends at least substantially around the interior boundary of the crib.

Another embodiment of the invention is a ventilated bumper for a crib having spaced side supports defining an interior boundary extending around the periphery of a mattress disposed in the crib and being spaced from the periphery of the mattress by a spacing. The ventilated bumper comprises a lower pad disposed at least partially in the space between the interior boundary of the crib and the periphery of the mattress. A ventilated portion is coupled with the lower pad and disposed at least partly above the upper surface of the mattress. The ventilated portion includes at least one opening for ventilating between the interior of the crib and the exterior of the crib through the spaced side supports. An upper pad is coupled with and disposed above the ventilated portion. In a specific embodiment, the ventilated portion extends at least substantially around the periphery of the mattress and has a generally uniform height between the lower pad and the upper pad of about 1–3 inches.

In accordance with another embodiment of the present invention, a ventilated bumper pad is provided in a crib having spaced side supports defining an interior boundary extending around the periphery of a mattress disposed in the crib and being spaced from the periphery of the mattress by a spacing. The ventilated bumper pad is configured to be supported in the spacing between the interior boundary of the crib and the periphery of the mattress. The ventilated bumper pad comprises a plurality of bumper pad segments each extending along a portion of the periphery of the mattress. The bumper pad segments are releasably coupled with each other. The ventilated bumper pad has at least one ventilated portion which includes a plurality of openings for ventilating between the interior of the crib and the exterior of the crib through the spaced side supports.

Another embodiment of the invention is a kit for ventilating a bumper pad for a crib having spaced side supports defining an interior boundary extending around the periphery of a mattress disposed in the crib and being spaced from the periphery of the mattress by a spacing. The kit comprises a lower pad coupled with an intermediate section. The lower pad is configured to be disposed at least partially in the space between the interior boundary of the crib and the periphery of the mattress to support the intermediate section above the upper surface of the mattress. The intermediate section has at least one ventilated portion which includes a plurality of openings for ventilating between the interior of the crib and the exterior of the crib through the spaced side supports. The kit includes at least one fastener for fastening an upper edge of the intermediate section to a lower edge of the bumper pad. The kit is easy to use and makes it even more economical for those who already own a non-ventilated bumper pad to convert it into a ventilated crib bumper.

Yet another embodiment of the present invention is a method of ventilating a bumper pad for a crib having spaced side supports defining an interior boundary extending around the periphery of a mattress disposed in the crib and being spaced from the periphery of the mattress by a spacing. The method comprises providing a lower pad coupled with an intermediate section. The intermediate section has at least one ventilated portion which includes a plurality of openings for ventilating between the interior of the crib and the exterior of the crib through the spaced side supports. The lower pad is placed at least partially in the space between the interior boundary of the crib and the periphery of the mattress to support the intermediate section above the upper surface of the mattress. An upper edge of the intermediate section is fastened to a lower edge of the bumper pad.

DESCRIPTION OF THE SPECIFIC EMBODIMENTS

Figure 1:
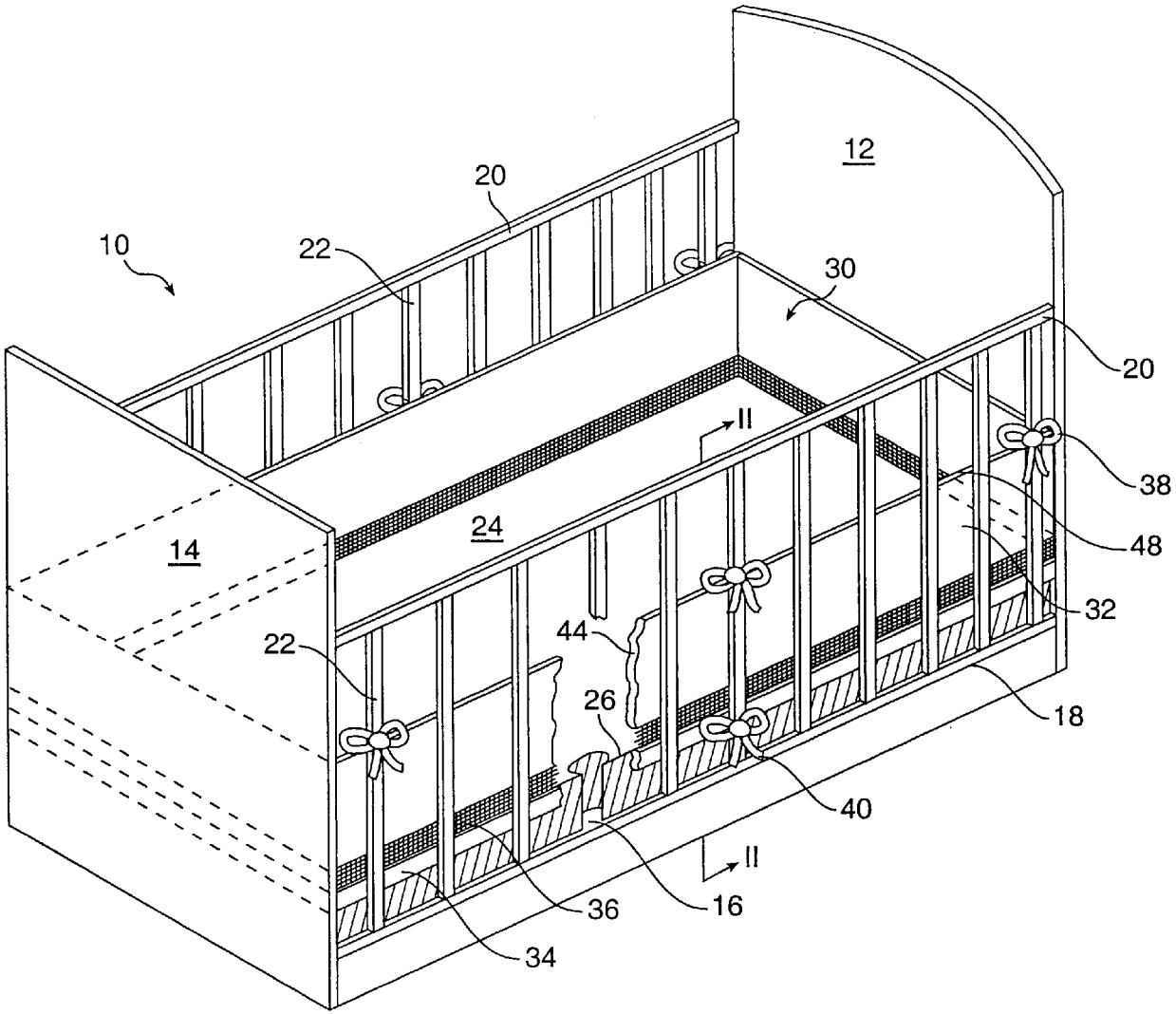
FIG. 1 is a perspective view of a crib bumper installed in a crib with a mattress according to an embodiment of the present invention.

FIG. 1 shows a typical crib 10 having a headboard 12, a footboard 14, and a bottom 16. On each of the two sides of the crib 10, a generally horizontal bottom rail 18 and a generally horizontal top rail 20 extend between the headboard 12 and the footboard 14. A plurality of generally vertical support posts or bars 22 extend from the bottom rail 18 to the top rail 20 on each side of the crib 10. The top rails 20 are typically attached to the headboard 12 and footboard 14 at a sufficient height above the bottom 16 so that the child cannot easily climb out of the crib 10. A mattress 24 is disposed on the bottom 16 of the crib 10, and has a periphery 26 which is surrounded by an interior boundary of the crib 10 defined by the headboard 12, footboard 14, and support posts 22 on the two sides.

Figure 2:
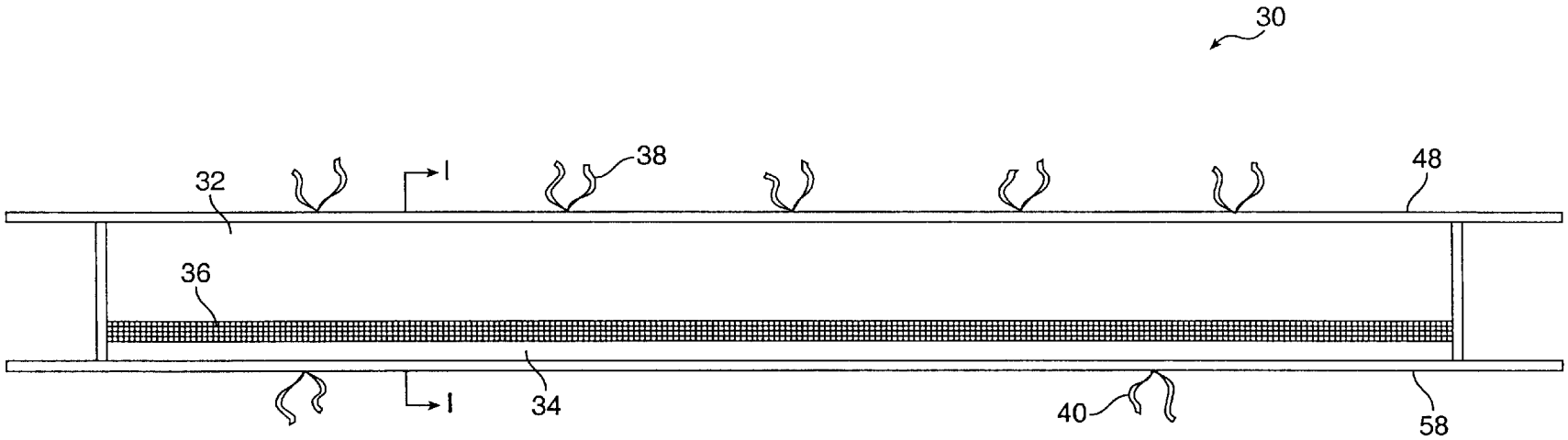
FIG. 2 is a front elevational view of the crib bumper of FIG. 1 in a laid-open position.

A crib bumper 30 is placed in the crib 10 and is typically set up along the interior boundary of the crib 10 to surround the periphery 26 of the mattress 24. As best seen in the laid-open position in FIG. 2, the crib bumper 30 has an upper pad 32, a lower pad 34, and a ventilation mesh 36 coupled between the upper pad 32 and the lower pad 34. A plurality of upper tie strings 38 are attached to the top edge of the upper pad 32 for securing the upper pad 32 of the crib bumper 30 to the support posts 22 of the crib 10, as best seen in FIG. 1. Lower tie strings 40 are provided at the bottom edge of the lower pad 34 for securing the lower pad 34 to the support posts 22 of the crib 10.

Figure 3:
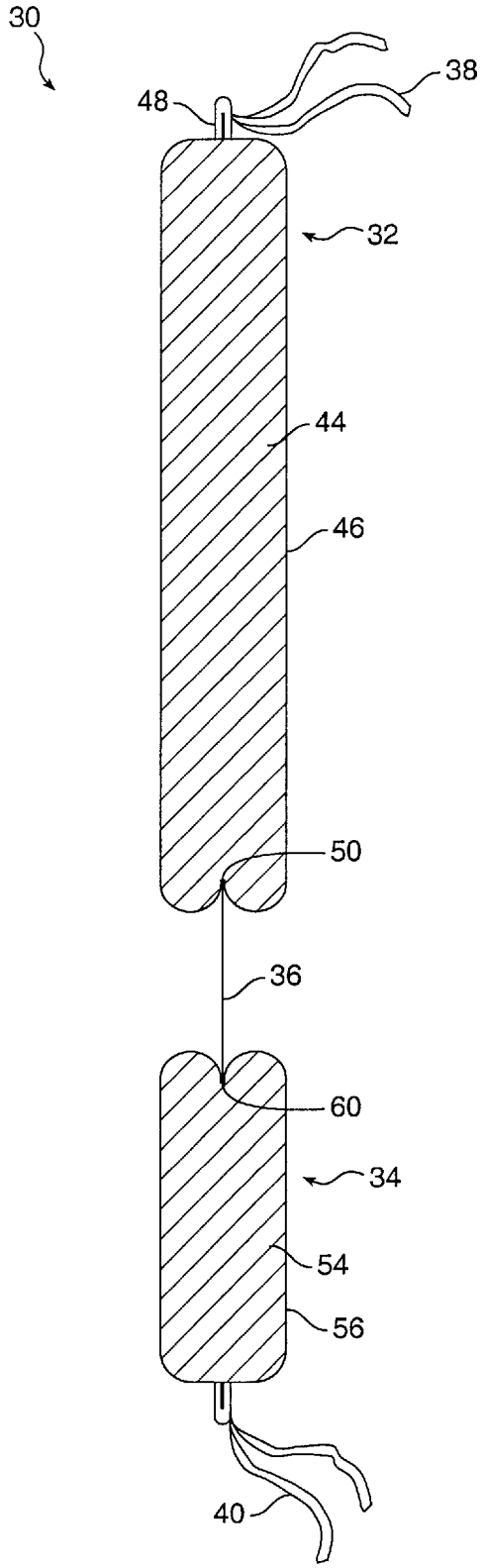
FIG. 3 is a cross-sectional view of the crib bumper of FIG. 2 along I—I.

FIG. 3 shows the cross-sectional view of the crib bumper 30. The upper pad 32 includes a filler material 44 inside a fabric cover 46. The filler material 44 typically is a polyester filler material but may include other materials such as foam padding, soft rubber, and the like. The upper edge of the fabric cover 46 is stitched to form a top seam 48. The upper tie strings 38 are stitched to the top seam 48. The lower edge of the fabric cover 46 is stitched with the top edge of the ventilation mesh 36 to form an upper mesh attachment seam 50. The lower pad 34 includes a filler material 54 inside a fabric cover 56. The lower edge of the fabric cover 56 is stitched to form a bottom seam 58. The lower tie strings 40 are stitched to the bottom seam 58. The upper edge of the fabric cover 56 is stitched with the bottom edge of the ventilation mesh 36 to form a lower mesh attachment seam 60. The material used in the crib bumper 30 is flexible so that it can be arranged into different shapes for installation in cribs of different sizes and shapes.

Figure 4:
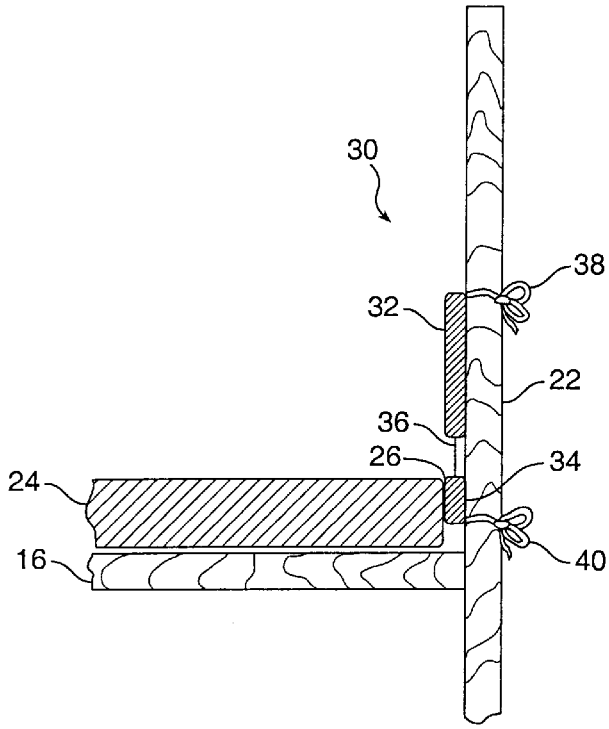
FIG. 4 is a partial cross-sectional view of the crib bumper of FIG. 1 along II—II illustrating the placement of the crib bumper relative to the mattress and the side supports of the crib.
Figure 5:
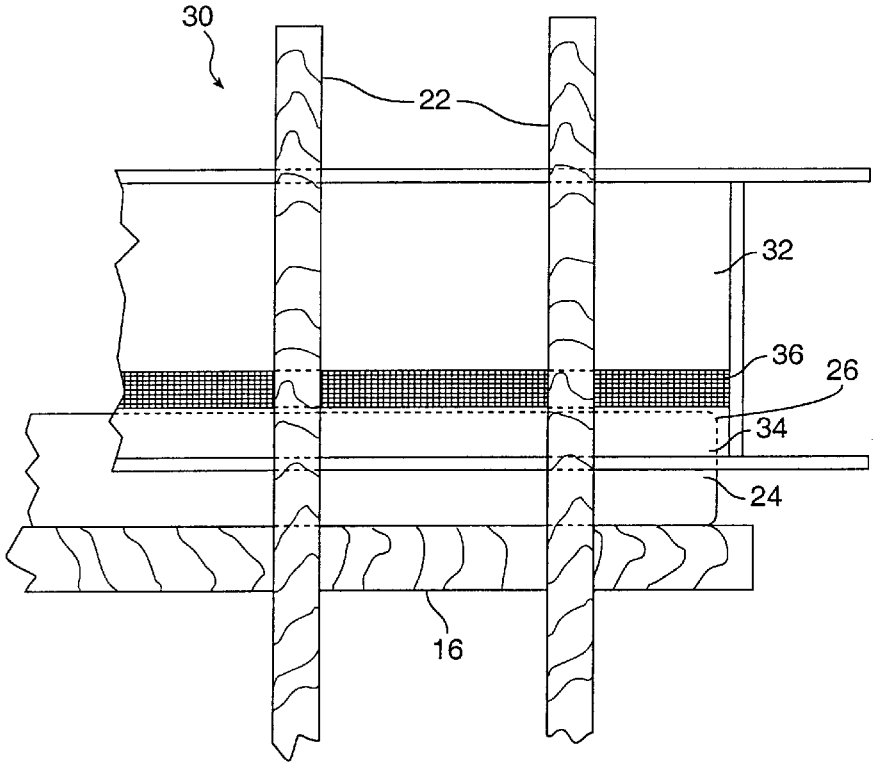
FIG. 5 is a front elevational view of the crib bumper of FIG. 1 installed in the crib overlapping with the mattress.

Referring to FIGS. 1, 4, and 5, the crib bumper 30 is shown installed inside the crib 10 in the set-up position. The lower pad 34 is disposed in the space between the interior boundary of the crib 10 and the periphery 26 of the mattress 24. The lower pad 34 overlaps with the side of the mattress 24, and can be secured to the side support posts 22 by the lower tie strings 40. The bottom of the ventilation mesh 36 is generally aligned with the upper surface of the mattress 24, but may be slightly below or above the upper surface. The upper pad 32 is secured to the side support posts 22 using the upper tie strings 38. In this embodiment, the ventilation mesh 36 has a generally constant height and extends around the entire periphery 26 of the mattress 24. The height of the mesh 36 is typically less than about 5 inches so that there are sufficient areas of padding to protect the child from bodily impact against the sides of the crib 10. In a specific embodiment, the height of the mesh 36 is about 1–3 inches. It is noted that the mesh 36 need not extend around the entire periphery 26 of the mattress 24 in alternative embodiments. For example, the mesh portions may be formed in rectangular patches alternating with padded portions. One advantage of having a continuous mesh 36 is that it is simpler and faster to manufacture, thereby reducing production time and cost. Another advantage is that the continuous mesh 36 provides better and more uniform ventilation so that trapping of dangerous gases in the crib 10 is reduced regardless of the position of the child. Further, a child may sometimes press its face into a comer while moving and crawling in the crib 10. The continuous mesh 36 ensures that the child has a supply of fresh air in those potentially dangerous positions.

When installed in the crib 10 as shown in FIG. 1, the padding in the upper pad 32 of the ventilated bumper 30 prevents or at least reduces bodily impact of the child against the headboard 12, footboard 14, and support posts 22. The ventilation mesh 36 keeps the child's body safely inside the interior boundary of the crib 10. At the same time, the ventilation mesh 36 allows carbon dioxide and other dangerous gases to escape through openings therein from the interior of the crib 10. The lower pad 34 is pressed down tightly in the space between the mattress 24 and the interior boundary of the crib 10 to anchor and support the ventilated bumper 30. The lower pad 34 also functions to hold down and maintain the mattress cover sheeting firmly in place. This eliminates bunching of the mattress covering and the creation of pockets which may collect and hold carbon dioxide or other dangerous gases inside the crib 10.

Figure 6:
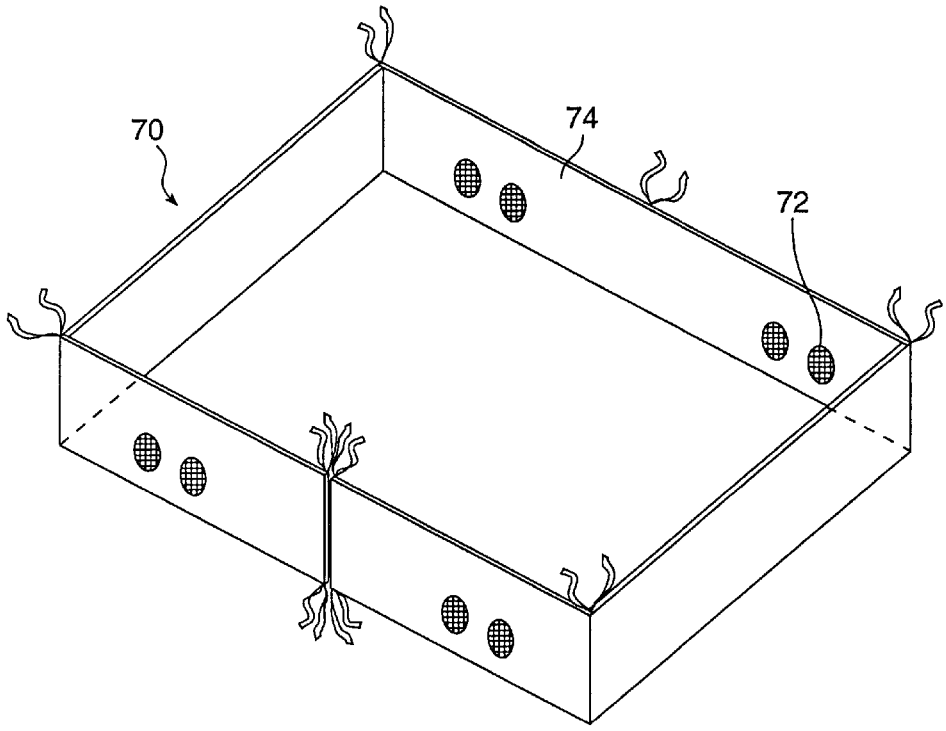
FIG. 6 is a perspective view of a crib bumper in a set-up position according to another embodiment of the present invention.
Figure 7:
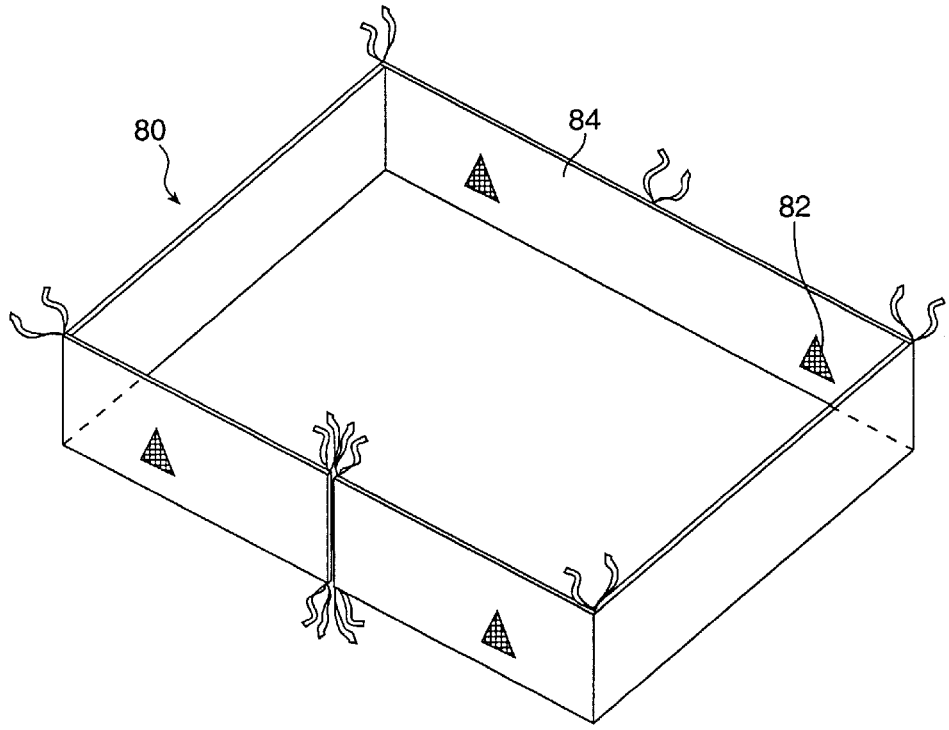
FIG. 7 is a perspective view of a crib bumper in a set-up position according to another embodiment of the present invention.

FIGS. 6 and 7 illustrate two alternative embodiments of the crib bumper employing multiple ventilation ports or patches. In the crib bumper 70 of FIG. 6, circular ventilation mesh ports 72 are provided at different locations and surrounded by padded regions 74 of the crib bumper 70. In FIG. 7, the crib bumper 80 includes spaced triangular ventilation mesh ports 82 surrounded by padded regions 84. Of course, other shapes can be used for the ventilation mesh ports.

Figure 8:
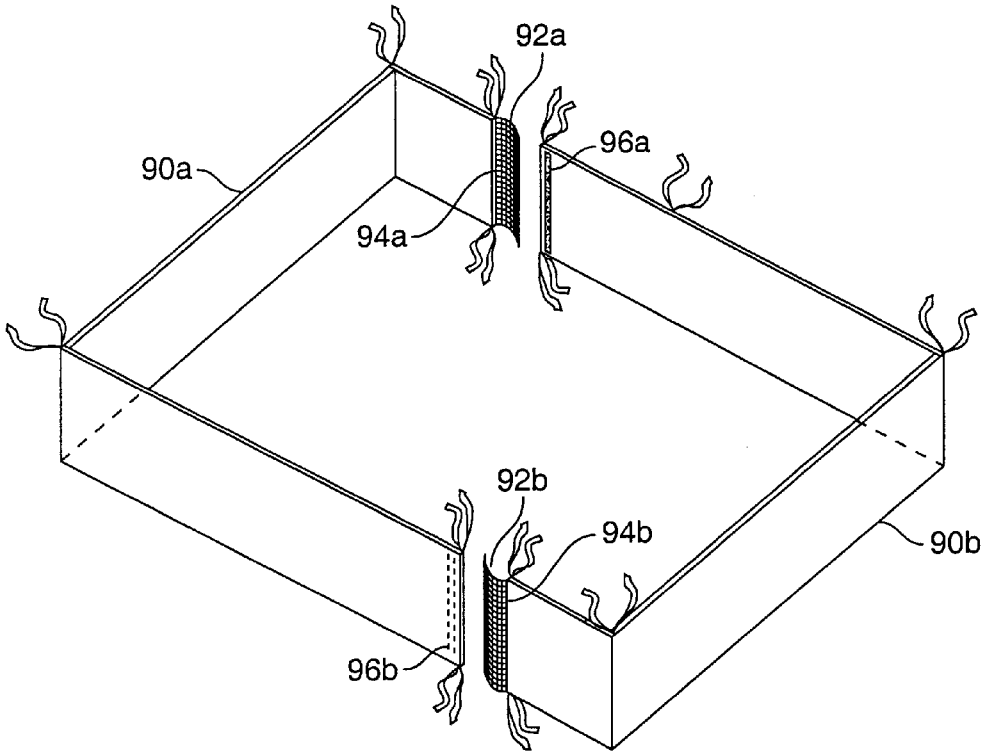
FIG. 8 is a perspective view of a crib bumper in a set-up position according to another embodiment of the present invention.

In another alternative embodiment shown in FIG. 8, a two-piece crib bumper has two bumper pieces 90*a*, 90*b* each extending over a portion of the periphery 26 of the mattress 24. Each bumper piece 90*a*, 90*b* has a ventilation flap 92*a*, 92*b* connected at one side by, e.g., stitching 94*a*, 94*b*. The other side of the ventilation flap 92*a*, 92*b* of each bumper piece 90*a*, 90*b* is connectable with the other bumper piece using a hook and loop fastener 96*a*, 96*b* or other fastening members.

Figure 9:
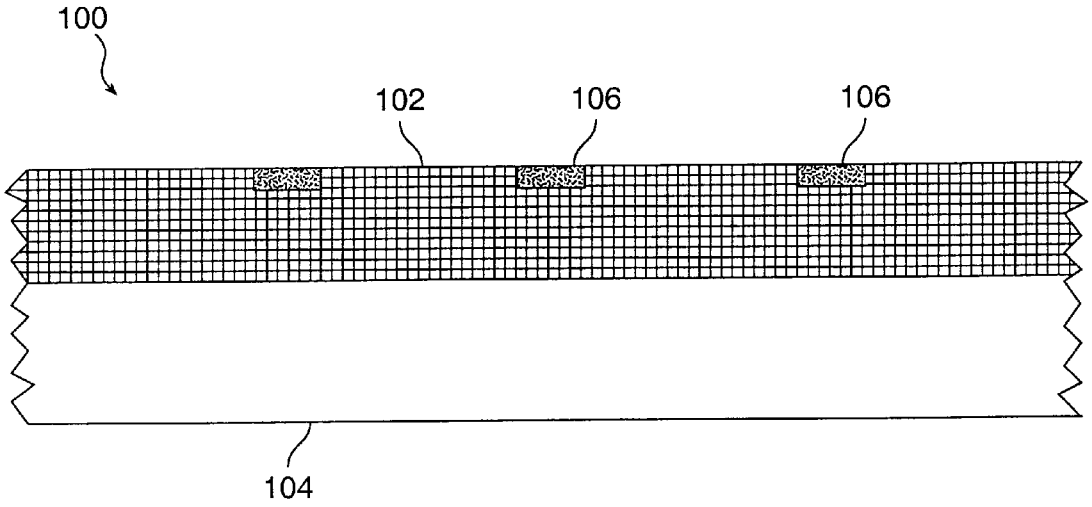
FIG. 9 is a front elevational view of a ventilation upgrade kit for non-ventilated bumpers.

A ventilation upgrade kit 100 for converting a non-ventilated bumper pad into a ventilated bumper is illustrated in FIG. 9. The kit 100 includes a ventilation panel 102 connected with a lower bumper pad 104. The ventilation panel 102 is attachable to the bottom of a non-ventilated bumper pad by sewing or other methods to form a ventilated crib bumper similar to that shown in FIGS. 1–3. In a preferred embodiment, the ventilation panel 102 includes one or more hook and loop fasteners 106 near the upper edge for connecting the ventilation panel 102 to the non-ventilated bumper pad.

The ventilated crib bumpers of the present invention can be used easily and conveniently to form a safer protective barrier around the interior boundary of the crib 10 which reduces the trapping of carbon dioxide and other dangerous gases inside the crib. The crib bumper is easily removable for laundering. The crib bumper can be produced easily and inexpensively. An easy-to-install upgrade kit makes it even more economical for those who already own a non-ventilated bumper pad to convert it to a ventilated crib bumper.

The above-described arrangements of apparatus and methods are merely illustrative of applications of the principles of this invention and many other embodiments and modifications may be made without departing from the spirit and scope of the invention as defined in the claims. For instance, the ventilated mesh may be replaced by other types of ventilation panels having small openings. The ventilated crib bumper can be sized to fit day travel cribs, bassinets, or other sleeping apparatus. The ventilation mesh can have a variety of decorative shapes such as star and animal shapes. The ventilated crib bumper can be manufactured using various methods. One alternative way is to employ a single piece of mesh and fill portions of the mesh with padding or breathable filling material.

What is claimed is:

1. A kit for ventilating a bumper pad for a crib having spaced side supports defining an interior boundary extending around the periphery of a mattress disposed in the crib and being spaced from the periphery of the mattress by a spacing, the kit comprising:

a lower pad coupled with an intermediate section, the lower pad configured to be disposed at least partially in the space between the interior boundary of the crib and the periphery of the mattress to support the intermediate section above the upper surface of the mattress, the intermediate section having at least one ventilated portion which includes a plurality of openings for ventilating between the interior of the crib and the exterior of the crib through the spaced side supports; and at least one fastener for fastening an upper edge of the intermediate section to a lower edge of the bumper pad.

2. The kit of claim 1 wherein the intermediate section comprises a ventilated portion extending at least substantially around the periphery of the mattress.

3. The kit of claim 2 wherein the ventilated portion has a height of less than about 5 inches.

4. The kit of claim 3 wherein the ventilated portion has a height of about 1–3 inches.

5. The kit of claim 1 wherein the at least one fastener includes a hook and loop fastener.

6. A method of ventilating a bumper pad for a crib having spaced side supports defining an interior boundary extending around the periphery of a mattress disposed in the crib and being spaced from the periphery of the mattress by a spacing, the method comprising:

providing a lower pad coupled with an intermediate section, the intermediate section having at least one ventilated portion which includes a plurality of openings for ventilating between the interior of the crib and the exterior of the crib through the spaced side supports;

placing the lower pad at least partially in the space between the interior boundary of the crib and the periphery of the mattress to support the intermediate section above the upper surface of the mattress; and fastening an upper edge of the intermediate section to a lower edge of the bumper pad.

* * * * *